United States Patent [19]

Allison

[11] 3,983,333

[45] Sept. 28, 1976

[54] LOUD SPEAKER SYSTEM

[75] Inventor: Roy F. Allison, Wayland, Mass.

[73] Assignee: Allison Acoustics Inc., Natick, Mass.

[22] Filed: Apr. 7, 1975

[21] Appl. No.: 565,875

Related U.S. Application Data

[63] Continuation-in-part of Ser. No. 447,065, March 1, 1974, abandoned.

[52] U.S. Cl. ..... 179/1 E; 181/144

[51] Int. Cl.[2] ..... H04R 1/28

[58] Field of Search ..... 179/1 E; 181/144, 148, 181/155, 198, 147, 156

[56] References Cited

UNITED STATES PATENTS

| | | | |
|---|---|---|---|
| 2,731,101 | 1/1956 | Klipsch | 179/1 E |
| 3,113,633 | 12/1963 | Eberhardt et al. | 179/1 GA |
| 3,241,631 | 3/1966 | Manieri | 179/1 E |
| 3,514,539 | 5/1970 | Jespersen | 179/1 E |
| 3,627,948 | 12/1971 | Nichols | 179/1 E |
| 3,670,842 | 6/1972 | Ekdahl | 179/1 E |

FOREIGN PATENTS OR APPLICATIONS

| | | | |
|---|---|---|---|
| 1,012,505 | 12/1965 | United Kingdom | 179/1 E |

*Primary Examiner*—Douglas W. Olms

[57] ABSTRACT

A room audio speaker system for use in combination with at least one room boundary surface, the speaker comprising an enclosure having a closed end wall for placement closely adjacent the room boundary surface and a second wall extending away from the end wall and providing a front edge and a rear edge, the latter forming a boundary with the end wall. Direct radiator audio reproducer means are provided generally flush mounted generally parallel to a portion of the exposed surface of the second wall. The included angle between the end wall and that second wall portion is no more than about 90°. The distance along the second wall from the center of the reproducer means to the rear boundary edge is not more than one-half the smallest outside dimension of the second wall and the closed end wall is free from any audio reproducer means.

14 Claims, 15 Drawing Figures

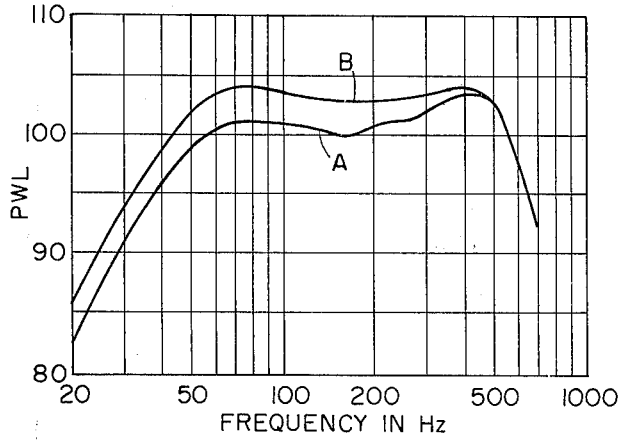
FIG. 7
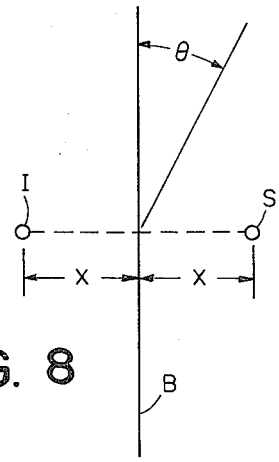
FIG. 8
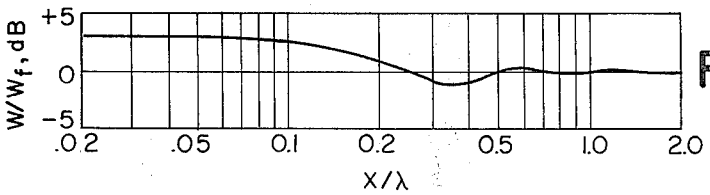
FIG. 9
FIG. 10
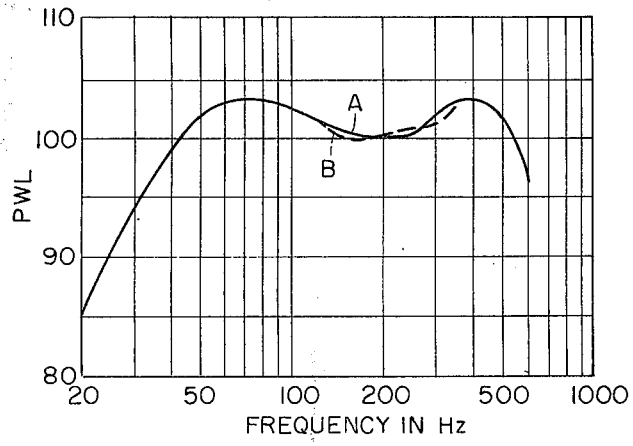

LOUD SPEAKER SYSTEM

CROSS REFERENCE TO RELATED APPLICATION

This is a continuation-in-part of copending Ser. No. 447,065, filed Mar. 1, 1974, for "Loud Speaker System," and abandoned from and after the filing of the present application.

BACKGROUND OF THE INVENTION

This invention relates to a room audio speaker system.

As is well known, direct radiator loudspeaker devices are extremely inefficient in transforming the power input to the loudspeaker (electrical watts) into acoustic power (acoustical watts). Typically, for conventional direct radiator loudspeaker systems with enclosures of approximately three cubic feet in volume or less, the efficiency is only about 1 percent. These low efficiencies are the result of an impedance mismatch which results because the resistive component of the radiation load is very small in comparison with other impedances in the electroacoustical circuit. As is also well known, the resistive component (the radiation resistance) is inversely proportional to the effective radiation angle, in steradians, into which the loudspeaker device radiates. Indeed, the acoustic power radiated by a direct radiator loudspeaker system will double with each halving of the effective radiation angle for the system. Thus, if the loudspeaker diaphragm of such a system could be mounted flush with a wall surface in a room and at some distance from adjacent walls, the radiation angle would be reduced from $4\pi$ steradians to $2\pi$ steradians with a consequent doubling of the radiation resistance and of the relative acoustic power over that of such a system placed far from any such boundaries. It is clearly impractical, however, to require the recessing of all audio speaker equipment into room walls.

In a typical home audio system the loudspeakers will be placed adjacent a wall or other boundary surface of a room and in such a location that the impact of the room boundary surface upon the effective radiation angle of the loudspeaker will be a function of the frequency of the radiated sound. For the distances typically involved, the room boundary surface may serve to reduce the effective radiation angle for audio frequencies in the lower end of the audible range. For conventional low frequency direct radiator systems (i.e., woofers) the impact of the room boundary surface is found to extend over only a portion of the frequency range of the loudspeaker. This results in a frequency response curve in which the power radiated varies greatly with the frequency of the sound, even though the woofer may be capable of uniform power output working into an unvarying radiation resistance. This of course is an undesirable condition and it has long been a goal of designers to provide low frequency audio loudspeaker systems which have a flat frequency response curve.

In view of the foregoing it is a principle object of the present invention to provide a direct radiator loudspeaker system which has an improved frequency response curve, especially in the low frequency range of typical audio systems.

Equivalently, it is an object of the present invention to provide such a system in which, for such frequencies, the effective radiation angle of the loudspeaker system is substantially invariant as a function of frequency.

SUMMARY OF THE INVENTION

To achieve these and other objects, the invention features a room audio speaker system for use in combination with intersecting room boundary surfaces. The speaker system comprises an enclosure having a closed end wall for placement closely adjacent a first boundary surface and side walls extending away from the end wall and providing a front edge, a rear edge, and side edges. The rear edge forms a boundary with the end wall and a side edge is closely adjacent a second room boundary surface. Direct radiator audio reproducer means, comprising a cone loudspeaker having a frequency range extending at least as low as 100 Hz, are substantially flush mounted generally parallel to a portion of the exposed surface of at least one of the side walls with the angle between the end wall and that portion being no greater than about 90°. The distance, along that side wall, from the center of the reproducer means to each of said rear boundary edge and said side edge of that side wall is not more than one-half the smallest outside dimension of the side wall. Preferably ech mounting panel lies substantially in a single plane and the loudspeaker has an upper cutoff frequency substantially equal to the frequency for which its center is approximately one-quarter wavelength from a room boundary surface. In an alternative embodiment, a single low frequency loudspeaker is supported on a panel having edges closely adjacent each of three room boundary surfaces.

BRIEF DESCRIPTION OF THE DRAWINGS

Other objects, features, and advantages of the invention will appear from the following description of particular preferred embodiments taken together with the accompanying drawings in which:

FIGS. 4–7 and 10–14 are frequency response curves for various room audio speaker systems and arrangements;

FIG. 8 is a diagram illustrating how the Pressure Directivity Pattern of a small sound source may be determined; and FIG. 9 is a graphical representation of the determination made in accordance with FIG. 8.

DETAILED DESCRIPTION OF PARTICULAR PREFERRED EMBODIMENTS

In considering the impact on the effective radiation angle of a loudspeaker system placed in relatively close proximity to one or more room boundary surfaces (i.e., floor, ceiling, and walls), the principle of images is of assistance. When a relatively small sound source is placed at a distance X from a large room boundary surface, the effect is very much the same as if the boundary did not exist and if another source (the "image" of the true source) was present on the other side of the boundary at the same distance from it. In this model there are two sources, equal in strength and vibrating synchronously in phase, separated by a distance of 2X. If the frequency of the sound being radiated is low enough that the distance 2X is but a small part of a wavelength, the radiation from the two sources combines essentially in phase in all directions and the acoustic power radiated is twice what the true source would radiate in the absence of the boundary.

Equivalently, the boundary reduces the effective radiation angle by a factor of two. The effective environment of the loudspeaker diaphragm is essentially the same as if it were flush-mounted in the boundary surface, at least for those frequencies for which the distance 2X is a small part of the wavelength.

Figure 4:
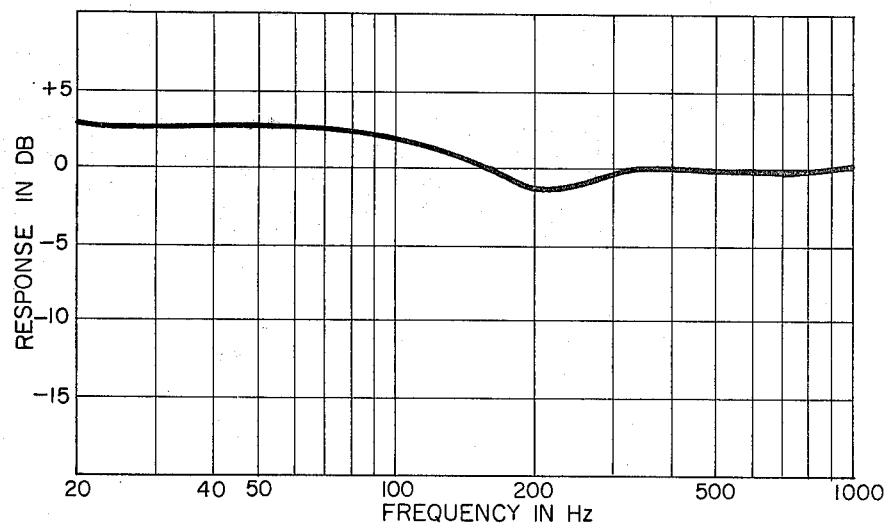

As the frequency increases, however, the wavelength decreases and the effect changes. At the frequency for which X is equal to one-quarter wavelength, radiation from the image source arrives at the true source with 180°phase inversion. Thus there is a complete cancellation of radiation in the direction at right angles to the room boundary surface, and the total power output (the sum of the acoustic power radiated in all directions) is halved relative to that of the lower frequency output discussed above. In other terms, the power output of this source is the same as it would be if there were no boundary whatsoever. At this frequency and above, the boundary has little influence on the effective radiation angle or the magnitude of the power output. FIG. 4 illustrates this effect and is a plot of the calculated total output, as a function of frequency, for a pair of simple sound sources separated by a one-half wavelength at 160 Hz. The wavelength at 160 Hz is approximately 7 feet and thus the sound sources are separated by three and one-half feet. (This arrangement is thus equivalent to a single sound source placed 1.75 feet from a large room boundary surface.) Referring to FIG. 4, the reference power level (0 dB) is that of the true source radiating into a $4\pi$ radiation angle (no boundaries nearby). From FIG. 4, it is clear that the boundary surface's presence halves the effective radiation angle at very low frequencies, thus increasing the acoustic power output, and has little influence on the effective radiation angle at frequencies above that for which the distance from the source is one-quarter wavelength (i.e., above 160 Hz).

In addition to the presence of nearby room boundary surfaces, there is another factor that operates to change the effective radiation angle with frequency, especially at low frequencies. Since the particular loudspeaker (e.g., the woofer) conventionally is mounted with the base of its cone flush with one of the panels of a speaker cabinet, the panel itself can create an effective boundary wall to limit the effective radiation angle to not more than $2\pi$ steradians at and above frequencies for which the minimum dimension of that panel is one-half wavelength.

A third factor may also be present. When two loudspeakers driven in phase and synchronization are mounted in the same cabinet and operate over the same frequency range (e.g., two woofers), they will behave in a manner similar to that of a source near a boundary and the source's image. Each loudspeaker reduces the effective radiation angle for the other at very low frequencies; specifically, frequencies for which the path length along the speaker cabinet surface between the centers of the loudspeakers is less than one-half wavelength. Their proximity thus increases the combined output of the speakers at low frequencies by up to a factor of two. Above the one-half wavelength separation frequency, however, the mutual influence of the loudspeakers is negligible and each will radiate power as if the other was not present.

Thus, for conventional direct radiator loudspeaker systems, it has been realized, according to the present invention, that there are three factors which can produce changes in effective radiation angle as a function of frequency, and thereby changes in radiated power with frequency. These three factors may be summarized as: (1) proximity to room boundary surfaces, (2) mounting panel dimensions, and (3) mutual coupling among multiple drivers operating in the same frequency range. According to the present invention, certain relationships between these factors have been discovered which cause the factors to produce a resultant frequency response curve which is much flatter than that of conventional loudspeaker systems, or, equivalently, a resultant effective radiation angle which is substantially independent of frequency.

In particular, it has been discovered that the path length along the surface of the speaker cabinet from the center of a single low frequency loudspeaker to one or more nearby room boundary surfaces must not be greater than about one-half the minimum dimension of the speaker cabinet panel on which that single loudspeaker is mounted. Furthermore, if there are more than one such speaker in the same enclosure and if their operating frequency ranges overlap, the distance from the center of each such loudspeaker to one or more room boundary surfaces must again be not more than one-half the minimum dimension of the panel upon which each speaker is mounted, and, additionally, the path length along the speaker cabinet surfaces between the centers of the two loudspeakers must not be greater than the minimum dimension of each of the panels on which the speakers are mounted.

Figure 1A:
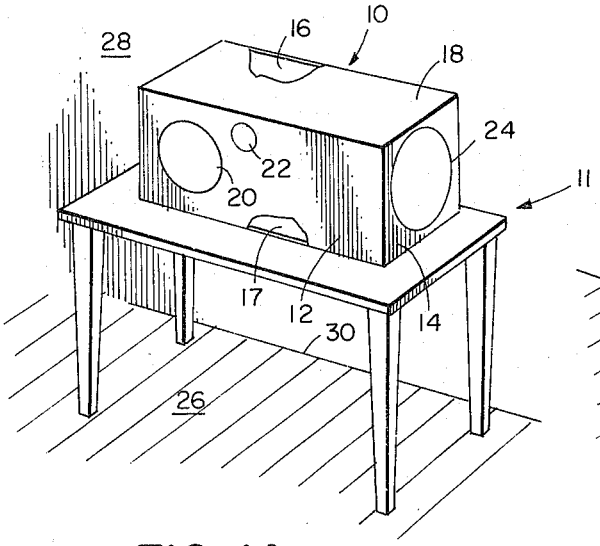
FIGS. 1A, 1B, 2, 3, and 15 are somewhat schematic illustrations of audio speaker systems constructed according to the present invention.
Figure 1B:
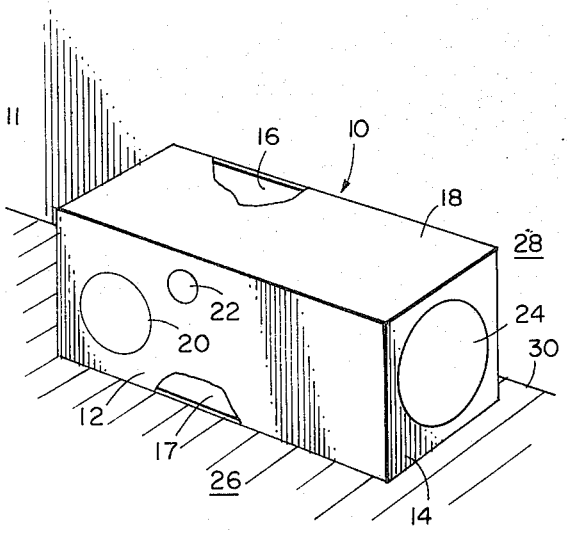
Figure 3:
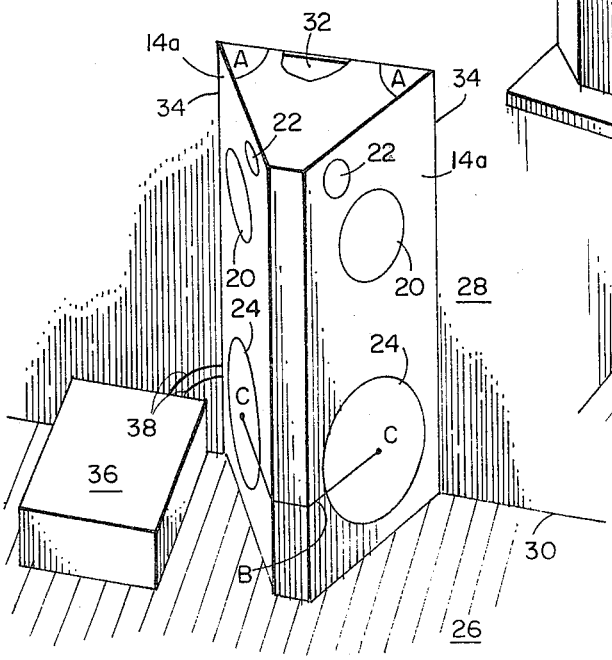
Figure 2:
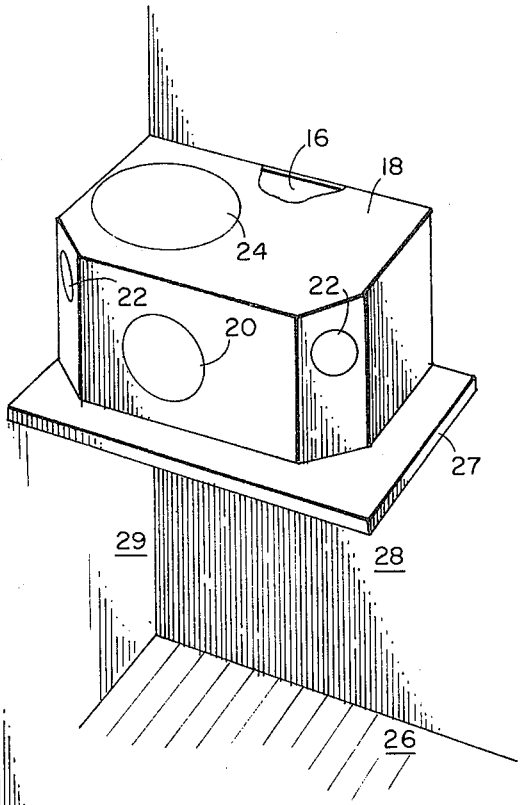

FIGS. 1–3 illustrate some possible configurations of speaker enclosures which make it possible and convenient for the above conditions to be achieved while retaining good middle and high frequency distribution into the room's listening area. The middle and high frequency loudspeakers are positioned in a conventional way for good distribution of the sound into the room, while the low frequency loudspeaker has its center closer to at least one nearby room boundary surface than one-quarter wavelength for all frequencies below which the cabinet mounting panel is an effective boundary surface itself. In this way, the room boundary surface (or surfaces) maintains its effectiveness in radiation angle reduction to the frequency at which the cabinet's mounting panel becomes effective in radiation angle reduction.

Referring in particular to FIG. 1A, the direct radiator loudspeaker system 10 comprises a box-like cabinet including a front wall 12, sidewalls 14, an end wall 16, a bottom wall 17, and a top wall 18. Middle and high frequency speakers 20, 22 are mounted flush in front wall 12. A low frequency loudspeaker 24 is mounted flush in one side wall 14. The loudspeaker preferably has a low frequency cutoff of no more than 100 Hz and an upper cutoff frequency substantially equal to the frequency for which its center is approximately one-quarter wavelength from the nearest room boundary surface. While the cabinet may be of any convenient dimensions as long as the relationships discussed above are maintained, the embodiment of FIG. 1 may conveniently be of the conventional shape in which the front wall is approximately one foot by two feet and side walls 14 are approximately one foot by one foot. As shown in FIG. 1A, the speaker is resting on a table 11 with end wall 16 closely adjacent and parallel to a room wall 28 which intersects the floor in a line 30. The angle between the end wall 16 and the side wall 14 is 90°.

Figure 5:
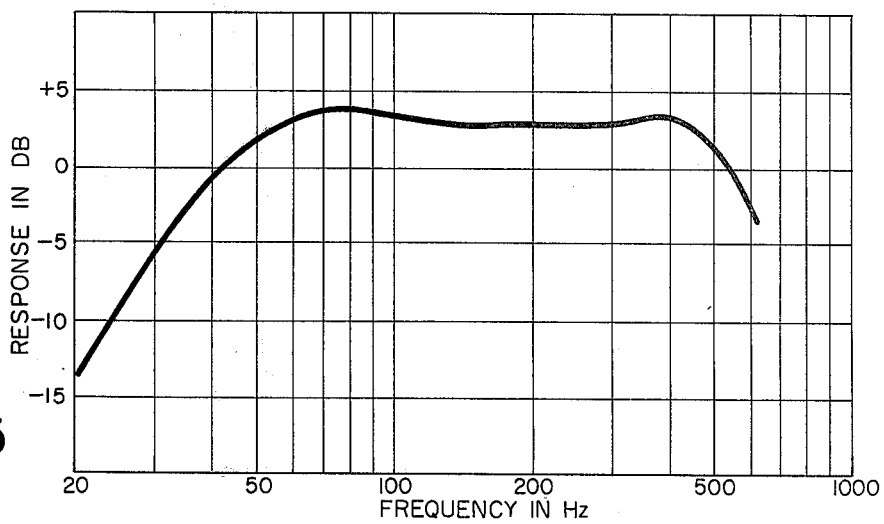

FIG. 5 is a plot, at low frequencies, of power output of the woofer 24 as a function of frequency for the embodiment shown in FIG. 1A. As is evident, the power radiated is quite uniform over the entire low frequency operating range of the woofer (i.e., about 60 Hz to about 500 Hz). Equivalently, a constant $2\pi$ effective radiation angle has been achieved.

Figure 6:
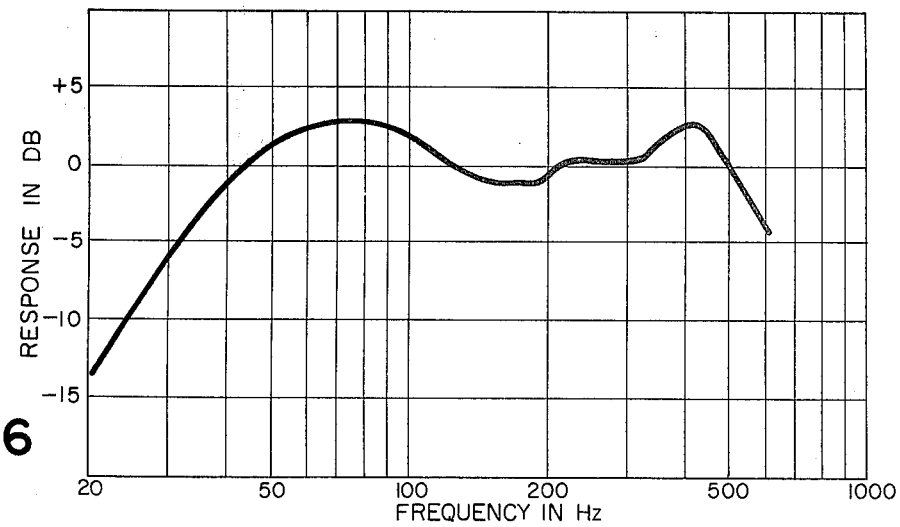

This may be compared with FIG. 6, which is a similar plot for a prior art speaker which is identical to that of FIG. 1 is every way except that the critical limitations have been violated by the placement of the low frequency loudspeaker 24 in the front wall 12. As is evident, this power curve is severely saddle-shaped. The wall serves as an effective $2\pi$ steradian boundary surface at low frequencies, for which the path length from the wall to the center of the low frequency loudspeaker 24 is substantially less than one-quarter wavelength, and the power radiated at those frequencies is thereby increased. As the frequency increases, the path length from the speaker 24 to the wall becomes a more significant part of a wavelength and the acoustic power output decreases. At 160 Hz, the path length is substantially equal to one-quarter wavelength and, as discussed above, the effective radiation angle is increased to $4\pi$ steradians with the resultant 3 dB reduction in power. Above 200 Hz the radiation angle begins to decrease again toward the $2\pi$ steradian value because the mounting panel (i.e., the front wall 12 in this prior art embodiment) becomes an effective $2\pi$ steradian boundary for these higher frequencies.

The embodiment shown in FIG. 1A, and others of generally similar design in placement of the woofer on an end wall, may also be situated at the intersection of two room boundaries, as shown in FIG. 1B, with further improvement in low-frequency performance. The radiation angle is reduced to $\pi$ steradians over the operating frequency range of the woofer because of its intimate proximity to two room boundaries rather than one, and its power output is thereby uniformly increased by another factor of two.

In FIG. 2, the low frequency loudspeaker 24 is mounted in the top wall 18 of a more complexly shaped speaker cabinet 10, supported on a shelf 27 at the intersection of walls 28, 29. The speaker 24 is again positioned closely adjacent the room boundary surfaces 28, 29 and in an appropriately sized panel, thereby meeting the critical limitations developed above.

In FIG. 3, a pair of low frequency speakers 24 driven in phase have been provided on the side wall panels 14*a* which intersect the end wall 32 along the rear boundary edges 34 of the side wall in an angle A of 45°. In this embodiment, the path length B, along the surfaces of the speaker cabinet 10, between the centers C of the speakers 24 is constrained to be not greater than the minimum dimension of the panels 14*a* upon which the speakers are mounted. With this speaker system, an amplifier 36 has a pair of output leads 38 for driving speakers 24 in phase.

Figure 15:
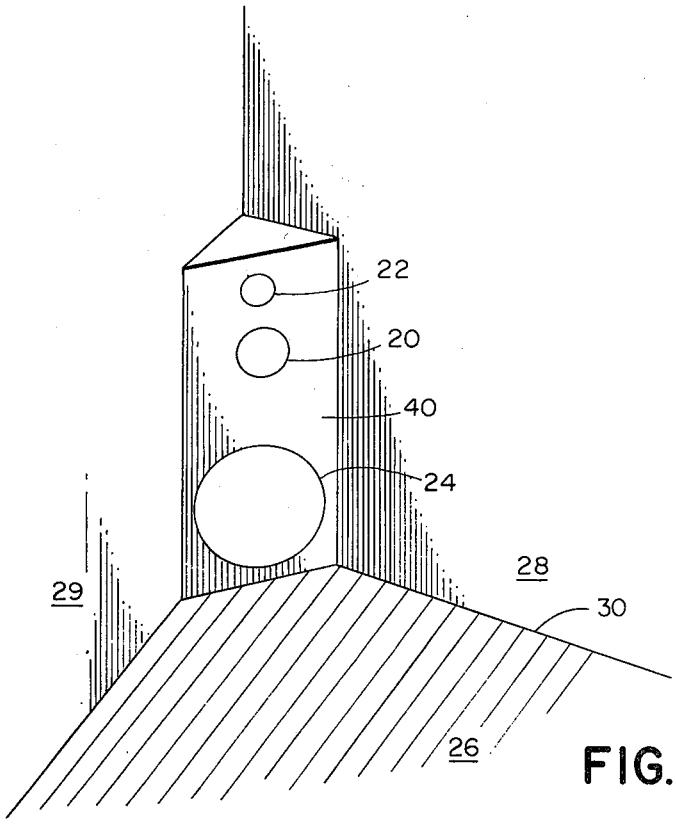

With any of the embodiments, of course, a further reduction in the effective radiation angle, and thus a further increase in the acoustic power output of the speaker system can be achieved by maintaining the critical limitations discussed above with respect to more than one room boundary surface. Thus, ignoring complex corner effects, if those limitations are maintained with respect to both a wall and the floor of the room a constant effective radiation angle of $\pi$ steradians would result. Referring to FIG. 15, a constant effective radiation angle of $\pi/2$ steradians would result by placing the panel 40 which supports a loudspeaker 24 on the floor 26 and angled across the intersection of two room walls 28, 29 while simultaneously maintaining the critical limitations with respect to both the floor and each of the walls.

As the following test results indicate, in realistic listening room situations these theoretical multiple-wall values are not achieved, although optimum arrangements are possible.

EXAMPLES

General

A single loudspeaker system, typical of the great majority now in use by serious listeners, was used for all tests. It is a three-way closed box acoustic suspension system, with a nominal crossover from woofer to mid-range speaker at 575 Hz. The grille cloth molding was removed for the tests, and the mid-range and tweeter speakers were disconnected. Without molding, the over-all dimensions of the cabinet were 25 inches by 14 inches by 10½ inches front to back. The woofer was nominally 12 inches in diameter and was centered in the 14 inches dimension of the front panel. Its center was located 7½ inches from one end of the 25 inches front-panel dimension.

Measurements were made outdoors. Sine wave signals were used. The boundaries were clay soil and poured concrete. Since the aim was to measure total power radiated, measurements of output were made so as to sample adequately the entire space into which the speaker radiated. Pressure levels obtained were converted to intensity, weighted according to solid angle represented, summed for the entire radiation angle, and the sum converted to PWL (power level re 130 dB=1 acoustic watt). As a check on accuracy of measurement equipment, the test system was checked for absolute output level vs. frequency in a $4\pi$ environment. Agreement was within 1 dB.

Test equipment consisted of the following Bruel & Kjaer units: type 1024 sine-random generator, type 4133 microphone, type 2619 preamplifier, type 4230 sound level calibrator, type 2113 spectrometer, and type 2305 level recorder. An Acoustic Research, Inc. power amplifier was used to drive the louspeaker.

FIG. 7 shows PWL vs. frequency for the test loudspeaker under two standard measurement conditions: $4\pi$ and $2\pi$ space. Note that the $4\pi$ curve (curve A) rises to and meets the $2\pi$ curve (curve B) at the upper end of the woofer's frequency range. This is explained by the fact that the minimum dimension of the cabinet front panel, 14 inches, is ½ wave length at 485 Hz. At this frequency and above, the panel is an effective $2\pi$ baffle for the woofer.

There are several possible methods for calculating the effect of a nearby boundary on the power output of a small source. One way, illustrated in FIG. 3, considers the source, *S*, and its image, *I*, beyond the boundary, *B*, to be a pair of small sources vibrating in phase and equal in strength. The pressure directivity pattern, *P*, for such a pair of sources is given by Beranek (*Acoustics*, McGraw-Hill Book Company, Inc., New York, N.Y. (1954), p. 94) as $$P = \frac{\sin\left[(4\pi X/\lambda)\sin\theta\right]}{2\sin\left[(2\pi X/\lambda)\sin\theta\right]}.$$

For each assumed value $x/\lambda$, the relative pressure is found at arbitrary distance for consecutive small increments of $\theta$. Squaring these pressure values, multiplying by cos $\theta$, and summing the values thus obtained yields the total relative power radiated, P, for the assumed value of $x/\lambda$:

$$P = \sum_{\theta=o}^{\pi} p^2 \cos \theta.$$

Repeating this process for the range of values of $x/\lambda$ of interest produces the curve shown in FIG. 9. A computer is most helpful in this task.

The predicted 3 dB augmentation of power output is obtained only when the source is a very small fraction of a wave length from the boundary. At 0.1 wave length the gain is about 2.5 dB. It falls to 0 dB (the full-space power output magnitude) at $\lambda/4$. An interesting phenomenon is apparent in the region between $\lambda/4$ and $\lambda/2$: the radiated power is actually less than the $4\pi$ space value, reaching a minimum of about −1 dB. Above $\lambda/2$, the boundary has virtually no effect on radiated power. If the distance between source and boundary is 24 inches, $\lambda/4$ occurs at 140 Hz.

EXAMPLE 1

(Test of Prior Art)

The test loudspeaker system was placed with its back close to a single wall (e.g., about ½ inch away) and with the woofer in the front panel directed away from the wall. This arrangement typifies a conventional speaker conventionally oriented with respect to room boundary surfaces. The PWL was measured as described above and is displayed as curve B of FIG. 10. The average path length from the center of the woofer to the wall was 21 inches. Using this value for $x$ in FIG. 9, and applying the boundary augmentation vs. frequency magnitudes so obtained to the full-space power curve in FIG. 7, the calculated power response is predicted and displayed as curve A of FIG. 10. This is in close agreement with the measured power vs. frequency curve, curve B.

The saddle-shaped power curves of FIG. 10 result from changes in the effective radiation angle over the woofer's operating range. At low frequencies the room boundary surface is effective in restricting the radiation angle to $2\pi$ steradians. In the middle frequency range the boundary surfce is too far away to serve this purpose, and the cabinet front panel is not large enough to have any effect. Consequently in this frequency region the radiation angle is $4\pi$ steradians. At higher frequencies the cabinet front panel reduces the effective angle again to $2\pi$.

EXAMPLE 2

Figure 11:
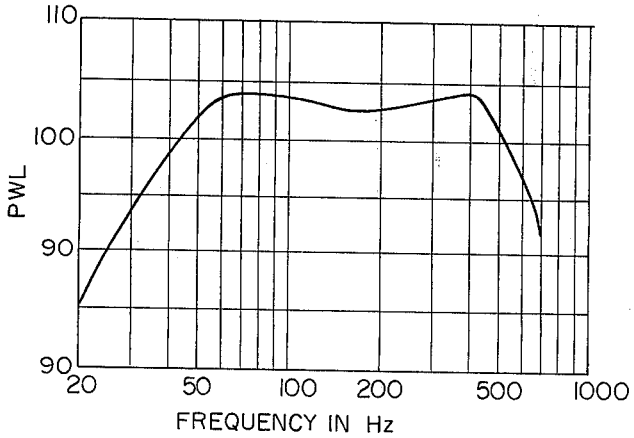

The test loudspeaker system was the same as in Example 1 but was rotated 90° with respect to the room boundary surface so that a "side"panel of the cabinet was parallel to, and about ½ inch from, the surface and the "front" panel, including the woofer, was perpendicular to the surface. The measured PWL is displayed in the curve of FIG. 11 and is seen to be substantially identical to the measured true $2\pi$ radiation angle response curve (i.e., curve B of FIG. 7). The only significant difference is an increase in cutoff slope above 450 Hz, where $x/\lambda$ is in the 0.25 to 0.5 range (an effect predicted by FIG. 9).

Example 3

Figure 12:
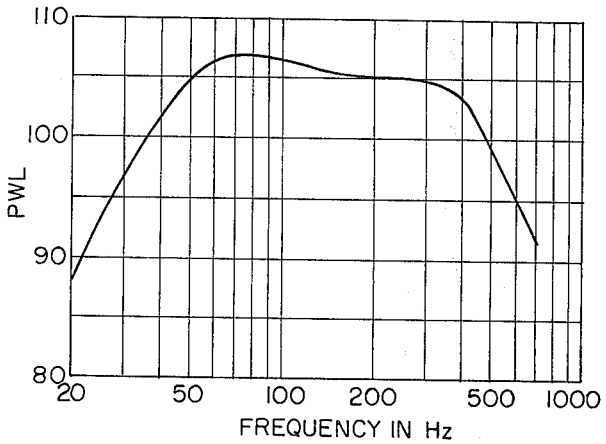

Real rooms, of course, have additional boundary surfaces which may affect the response of the loudspeaker system. In this test the system as previously described was placed with the woofer's panel perpendicular to both a wall and the floor. Two edges of that panel were, respectively, in contact with the floor and spaced one inch from the wall (to allow for a baseboard), with actual distances from the woofer's center to the surfaces being 7½ and 8 inches, respectively. The system was very far from any other boundaries. The resulting PWL curve is displayed in FIG. 12. As is clear, the effective radiation angle of $\pi$ steradians is well maintained, although the complications introduced by the second boundary have caused a reduction in the upper cutoff frequency (compare with FIG. 11). The curve of FIG. 12 corresponded very well with the result calculated from theoretical considerations.

EXAMPLE 4

Figure 13:
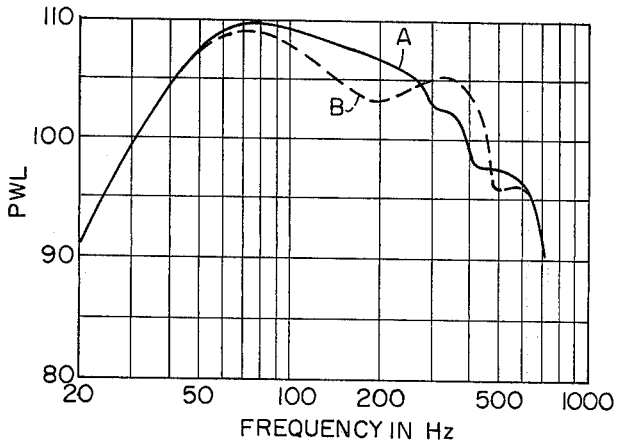
Figure 14:
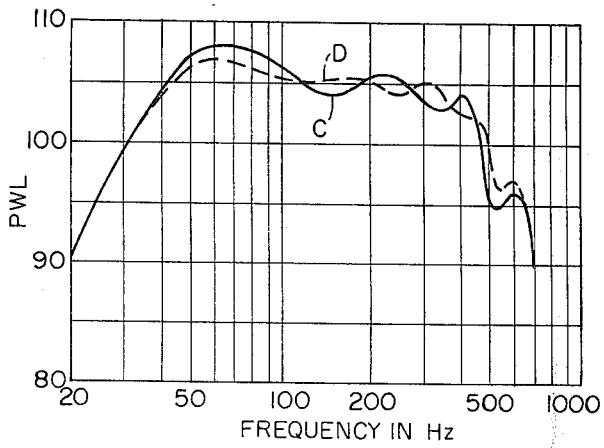

The identical test arrangement of Example 3 was employed, but a second wall was added perpendicular to the first wall and behind the woofer at distances of, respectively, (a) 11 inches, (b) 24 inches, (c) 36 inches, and (3) 48 inches. The measured PWL curves are displayed in FIGS. 13 and 14 as, respectively, curves A, B, C, and D. Analysis of these curves indicates, that if one cannot meet the criteria of the present invention with respect to the third boundary surface, the farther the system is spaced from that surface, the flatter the response curve becomes. At the four foot distance (curve D), power output variation is only 1½ dB up to 450 Hz.

Other room boundaries in addition to the three nearest the source will generate standing waves at the room resonance modes, but will have little effect on power output. In most cases the nearest "other" boundary, for a system placed as in Example 4, will be the ceiling. A boundary has been found to have little effect beyond $0.75\lambda$. If the ceiling is 7½ feet above the woofer, it will be $0.75\lambda$ away at 113 Hz. Therefore the three nearest boundaries alone control the effective radiation angle above 113 Hz. Between 113 and 75 Hz, this hypothetical ceiling reflection would increase power output very slightly, reaching a maximum of less than 1 dB at about 92 Hz. Radiated power would be decreased between 75 and 37.5 Hz, with a minimum of about −1 dB at 53 Hz. Power output would be increased gradually below 37.5 Hz, reaching +2 dB at 20 Hz and increasing asymptotically towards +3 dB at still lower frequencies.

While particular preferred embodiments have been illustrated in the accompanying drawing and described in detail herein, other embodiments are within the scope of the invention and the following claims.

I claim:

1. A room audio speaker system for use in combination with first and second boundary surfaces, said system comprising at least one cone loudspeaker having a frequency range extending at least as low as 100 Hz, and an enclosure including a closed end wall for placement closely adjacent said first boundary surface and a mounting panel on which said cone loudspeaker is mounted extending away from said end wall and forming an angle of not more than 90° with said end wall, said system being characterized in that:

said mounting panel provides a rear edge forming a boundary with said end wall, a side edge disposed for placement closely adjacent said second boundary surface when said end wall is closely adjacent said first boundary surface, and a front edge;

said mounting panel has a predetermined minimum dimension in a direction parallel to the outer surface of said mounting panel defining a predetermined frequency above which said panel reduces the effective radiation angle of said cone loudspeaker;

the distance along said mounting panel from the center of said cone to each of said side edge and said rear edge is not more than one-half said predetermined minimum dimension whereby when a said side or rear edge is adjacent a said boundary surface the effective radiation angle of said cone loudspeaker at frequencies below said predetermined frequency is reduced;

at least one of said boundary surfaces is a room boundary surface;

said system includes a second said cone loudspeaker; and the distance along said enclosure between the centers of said cone loudspeakers is not greater than said predetermined minimum dimension.

2. The system as claimed in claim 1 wherein said cone loudspeakers are driven in phase.

3. A room audio speaker system for use in combination with first and second boundary surfaces, said system comprising at least one cone loudspeaker having a frequency range extending at least as low as 100 Hz, and an enclosure including a closed end wall for placement closely adjacent said first boundary surface and a mounting panel on which said cone loudspeaker is mounted extending away from said end wall and forming an angle of not more than 90° with said end wall, said system being characterized in that:

said mounting panel provides a rear edge forming a boundary with said end wall, a side edge disposed for placement closely adjacent said second boundary surface when said end wall is closely adjacent said first boundary surface, and a front edge;

said mounting panel has a predetermined minimum dimension in a direction parallel to the outer surface of said mounting panel defining a predetermined frequency above which said panel reduces the effective radiation angle of said cone loudspeaker;

the distance along said mounting panel from the center of said cone to each of said side edge and said rear edge is not more than one-half said predetermined minimum dimension whereby when a said side or rear edge is adjacent a said boundary surface the effective radiation angle of said cone loudspeaker at frequencies below said predetermined frequency is reduced;

said system is for use in combination also with a third boundary surface and at least two of said boundary surfaces are room boundary surfaces;

said cone loudspeaker is the only loudspeaker of said system having a frequency range extending at least as low as 100 Hz;

said mounting panel has a second side edge disposed for placement closely adjacent said third boundary surface; and, the distance along said mounting panel from the center of said cone loudspeaker to said second side edge is not more than one-half said predetermined minimum dimension of said mounting panel.

4. A room audio speaker system for use in combination with first and second boundary surfaces, said system comprising at least one cone loudspeaker having a frequency range extending at least as low as 100 Hz, and an enclosure including a closed end wall for placement closely adjacent said first boundary surface and a mounting panel on which said cone loudspeaker is mounted extending away from said end wall and forming an angle of not more than 90° with said end wall, said system being characterized in that:

said mounting panel provides a rear edge forming a boundary with said end wall, a side edge disposed for placement closely adjacent said second boundary surface when said end wall is closely adjacent said first boundary surface, and a front edge;

said mounting panel has a predetermined minimum dimension in a direction parallel to the outer surface of said mounting panel defining a predetermined frequency above which said panel reduces the effective radiation angle of said cone loudspeaker;

the distance along said mounting panel from the center of said cone to each of said side edge and said rear edge is not more than one-half said predetermined minimum dimension whereby when a said side or rear edge is adjacent a said boundary surface the effective radiation angle of said cone loudspeaker at frequencies below said predetermined frequency is reduced;

at least one of said boundary surfaces is a room boundary surface; and said loudspeaker has an upper cutoff frequency not higher than the frequency for which the center of said loudspeaker is one-quarter wavelength from one of said end wall and said side edge.

5. The audio room system of claim 4 further characterized in that said cone loudspeaker is the only audio reproducer means mounted on said mounting panel, and in that said enclosure includes a second mounting panel generally perpendicular to said first mentioned mounting panel and audio reproducer means having a frequency range extending above the frequency range of said cone loudspeaker mounted on said second mounting panel.

6. The audio room system of claim 4 further characterized in that audio reproducer means having a frequency range extending above the frequency range of said cone loudspeaker is mounted on said mounting panel.

7. A room audio speaker system for use in combination with at least one room boundary surface comprising:

an enclosure having a closed end wall free from any audio reproducer means and adapted for placement closely adjacent said room boundary surface, a pair of side walls, each of said pair extending away from said end wall at an angle with respect to said end wall of no more than 90° and providing a front edge, side edges, and a rear edge, said rear edge of each of said pair forming a boundary with said end wall, and said front edges of said pair being closely adjacent and connected to each other whereby said end wall and said side walls define a triangle in cross-section; and, direct radiator audio reproducer means mounted on each of said pair of walls midway between said front edge and said rear edge of said each of said pair of walls for projecting sound outwardly therefrom.

8. A room audio speaker system as claimed in claim 7 wherein said audio reproducer means are driven in phase.

9. A room audio speaker system as claimed in claim 7 wherein one side edge of each of said pair of side walls is disposed for placement closely adjacent a second boundary surface.

10. The audio room system of claim 9 wherein the distance from the center of each of said audio reproducer means to the said one side edge of the side wall on which said each reproducer means is mounted is not more than one-half the distance from the rear edge to the front edge of said side wall on which said each reproducer means is mounted.

11. The audio room system of claim 9 wherein each of said audio means is a cone loudspeaker, the distance along each of said pair of walls from the front edge thereof to the rear edge thereof is a predetermined distance defining a predetermined frequency above which said each of said pair of walls reduces the effective radiation of the said cone loudspeaker means mounted thereon, and the distance from the center of the said cone loudspeaker mounted thereon to each of the said rear edge and the said one side edge is not more than one-half said predetermined distance.

12. The audio room system of claim 11 wherein each of said cone loudspeaker has a cutoff frequency not greater than the frequency from which one-half said predetermined distance is one-quarter wavelength.

13. The audio room system of claim 7 wherein the distance from said rear edge to said front edge of one of said side walls is equal to the distance from said rear edge to said front edge of the other of said side walls, and wherein each of said side walls forms an angle of less than 90° with said end wall and with the other of said side walls.

14. The audio room system of claim 13 wherein the distance from said rear edge thereof to said front edge thereof of each of said side walls is a predetermined distance above which said each of said pair of walls reduces the effective radiation of the said audio reproducer means mounted thereon, one side edge of each of said side walls is disposed for placement closely adjacent a second boundary surface, and the distance from each of said audio reproducer means to the said one side edge of the side wall on which said audio reproducer means is mounted is not more than one-half said predetermined distance.

* * * * *